US005545086A

United States Patent [19]

Sharp et al.

[11] Patent Number: 5,545,086

[45] Date of Patent: Aug. 13, 1996

[54] AIR FLOW CONTROL FOR PRESSURIZED ROOM FACILITY

[75] Inventors: Gordon Sharp, Newton, Mass.; Jerome Dean, Rochester, N.Y.; Eric Desrochers, Nashua, N.H.

[73] Assignee: Phoenix Controls Corporation, Newton, Mass.

[21] Appl. No.: 292,783

[22] Filed: Aug. 18, 1994

[51] Int. Cl.[6] ..... F24F 11/047

[52] U.S. Cl. ..... 454/238; 454/229

[58] Field of Search ..... 454/59, 61, 229, 454/238, 239

[56] References Cited

U.S. PATENT DOCUMENTS 4,392,177 7/1983 Johannsen ..... 454/229 X
4,773,311 9/1988 Sharp ..... 454/239 X
5,250,783 4/1993 Diechert et al. ..... 454/238
5,385,505 1/1995 Sharp et al. ..... 454/238

FOREIGN PATENT DOCUMENTS 3933 1/1986 Japan ..... 454/238

*Primary Examiner*—Harold Joyce
*Attorney, Agent, or Firm*—Wolf, Greenfield & Sacks, P.C.

[57] ABSTRACT

A control is provided for a facility which has at least one pressurized room which control facilitates the making of selected changes in offset between the room and a space external thereto while maintaining a desired air flow balance. This is accomplished at least in part by making changes in the air flow for the external space in connection with such offset changes.

18 Claims, 4 Drawing Sheets

AIR FLOW CONTROL FOR PRESSURIZED ROOM FACILITY

FIELD OF THE INVENTION

This invention relates to air flow balance and control in facilities having at least one pressurized room and more particularly to a control for effecting selected air flow offset changes while maintaining a desired air flow balance between at least one pressurized room and an external space connected to each such room.

BACKGROUND OF THE INVENTION

Pressurized containment/isolation rooms or other pressurized spaces (such rooms or spaces being hereinafter collectively referred to as rooms) are finding increasing application in industry, research laboratories, medical facilities and other institutions. In particular, negatively pressurized rooms may be utilized to contain contaminants, for example toxic gases, in industrial and laboratory facilities and to isolate infectious patients, for example patients with TB, in medical facilities. Similarly, positively pressurized rooms may be utilized for isolation or to prevent contamination in clean room areas such as those used in the manufacture of semiconductor products and other delicate industrial procedures and to protect immune deficient patients, such as those with AIDS, in a medical facility. Such facilities may have a single pressurized room connected to an external space such as a hall, or may have a number of such rooms connected to a common corridor.

Since, even in well-sealed pressurized rooms, there is some air flow through and around closed doors and through walls, it is necessary to maintain some pressure and air flow offset between the corridor and each room on the corridor in order to assure the desired containment/isolation. However, since air flow conditions in a room, in the corridor, and between the two are not static, but may undergo both small and relatively large changes, a control system is required which can respond to selected conditions which may require a change in offset to thereby maintain desired isolation/containment. For example, under ordinary conditions when a door is closed between a pressurized room and an adjacent corridor, an air flow velocity between the two of as little as 100 cubic feet per minute (cfm) may be adequate for containment/isolation purposes, and air flow velocities of this magnitude may be utilized, particularly when the air flow volume through the room is relatively low. Such low air flow is desirable since it minimizes energy utilization. However, such an air flow is not considered adequate when the door is open (see ANSI Z9.5 Standard). One reason for this is that there may be an appreciable temperature difference between the pressurized room and the adjoining space resulting in a thermal exchange of warmer air flowing in one direction at the top of the doorway and cooler air flowing in the opposite direction near the floor. An air flow velocity of at least 50 fpm is required to inhibit such thermal exchange under normal conditions and a flow rate of 100 fpm is more desirable to assure isolation/containment. Since for a typical 3'×7' open doorway, 1,050 to 2,100 cubic feet per minute (cfm) is therefore required for containment, and this volume is independent of the size of the room or of the cfm of the pressurized room supply and exhaust, the arbitrary 10% "offset" of the room total ventilation rate which is frequently used as the benchmark for the offset is not adequate when the door is open and an increase in air flow offset may be required when this occurs. Similarly, when the door is closed, this offset volume should drop back to the more typical offset volume of 100 to 200 cfm in order to save energy.

Another reason for changing the offset air volume would be when it is desired to change a room from a positive offset to a negative offset or vice versa. This can be desirable in a hospital isolation room where flexible use of the room for either negative isolation or containment, for example for a tuberculosis patient, may be needed one day, and a positive protective isolation is desired on another day for a patient with AIDS or another immunodeficiency disease. Consequently, the offset air volume of the room may need to be changed from a negative 100 cfm to a positive 100 cfm. Similar requirements can exist in animal research facilities or in flexible-use lab facilities of other kinds. A particular problem in this situation is that the corridor typically has a fixed air flow which is based on the projected offsets for each of the rooms serviced by the corridor. Thus, if there are five rooms each having an offset of −100 cfm, the air flow into the corridor might be 500 cfm. However, if one of these rooms is changed so as to be positively pressurized to 100 cfm, the net offset is only 300 cfm but the air flow into the corridor is 500 cfm resulting in an lair flow imbalance.

Further, there may be circumstances where for energy conservation or other reasons, it may be desirable to have a room offset that varies based for example on a percentage of the actual exhaust or supply volume rather than being a fixed percentage of the maximum possible exhaust or supply volume. Such a change may either be continuous or may be staged or stepped, being for example 200 cfm for exhaust volumes between 1,000 and 2,000 cfm of exhaust volume and 100 cfm for volumes of exhaust below 1,000 cfm.

Further, when a substantial change occurs in either the room or the external space/corridor, a change in offset air volume may be required to maintain balance. For example, if there is an emergency situation in a laboratory, for example a spill of toxic material, the fume hood in the laboratory may switch or be switched to a high volume condition resulting in large amounts of air being exhausted from the room. Depending on the supply capacity available to the room, this may cause a corresponding increase in the air flow offset between the room and the adjacent corridor.

However, when a change in air flow offset occurs, effective means is required for controlling the corresponding or counterbalancing offset or transfer from the adjoining space or corridor to prevent large imbalances in the corridor or even in the entire building's pressurization. Left uncompensated, a large variation in the offset air flow for one room could severely affect the pressurization of a corridor which could in turn affect the relative pressure difference and offset volumes between the corridor and other pressurized rooms on the same corridor. In a worst case scenario, this could permit loss of pressure differential in another pressurized room on the corridor which room has a small pressure offset, permitting, for example toxic fumes to enter the room from fume hood therein, and possibly even permitting such fumes or other contaminants to enter the corridor. Negative pressure in the corridor could also make it more difficult to open doors, thus impeding the ability of occupants of the various rooms to escape from the area. This scenario is clearly undesirable.

A related problem is a requirement in some applications that the corridor or other common space be isolated from offset changes required in a given room. This, among other things, improves isolators/ containment between the room and corridor, minimizes potential interaction between rooms on the same corridor and eliminates the need to make balancing changes in the corridor or compensate for desired offset changes for the room. A simple and effective way of achieving this objective does not currently exist.

One prior art system which attempted to deal with this problem involved measuring the differential pressure between the room and the corridor and then controlling the supply of air into the room or the exhaust of air from the room to maintain a set value of room pressure. Such system also used a differential pressure sensor to measure the pressure of the corridor versus some reference point or location either inside or outside the building. A controller accepts the sensed pressure value and then controls a supply valve, damper or equivalent element to provide proper corridor pressure. One problem with this system is that the set point pressure values are very low, resulting in the signals being very noisy and subject to disturbance by walking down the, corridor, wind loads on the building, doors to other areas opening and closing, etc. The result is an inaccurate matching of the offset air volume, slow response time and poor stability of control.

Other systems may, for example, control supply volume into a room and/or exhaust volume from the room based on supply volume from other rooms feeding into the pressurized room but do not directly control the offset air flow between the sealed room and external spaces.

A need therefore exists for an improved control system for use in facilities having one or more pressurized rooms for facilitating selected air flow offsets changes while maintaining a desired air flow balance between the rooms and an external space connected to the rooms.

SUMMARY OF THE INVENTION

In accordance with the above, this invention provides a control for maintaining a desired air flow balance between at least one pressurized room and an external space connected to each room. There is normally a selected air flow offset between each room and the external space with an element being provided which generates a signal indicative of a selected offset changing condition for each of the air flow offsets. There is also an air flow control for the external space which is responsive to each of these signals for changing the air flow in at least the external space to achieve the selected changed offset while maintaining the desired air flow balance. The air flow control for the external space may control the makeup air supply for the external space, and exhaust for the external space or both. There is also an air flow control for each of the pressurized rooms. For preferred embodiments, the air flow control for the room is also responsive to a signal indicative of a selected offset changing condition to effect an appropriate air flow change in the room. This control may be a change in air flow supply to the room, air flow exhaust from the room or both.

For some embodiments of the invention, a sensor is provided for detecting the open state of a door between each room and the corresponding external space. This sensor may be a two position sensor which generates a first signal when the door is closed and a second signal when the door is open by more than a selected amount, may be a multi-position sensor which generates signals in response to the door being within selected ranges of open positions, or may generate an output signal which is a substantially continuous and preferably linear function of door position. Where the room is negatively pressurized relative to the external space, the air flow control is responsive to a signal from the sensor indicating that a door is open for increasing the quantity of makeup air supplied to the external space, while if the room is positively pressurized relative to the external space, the air flow control is responsive to a signal indicating that the door is open for decreasing the quantity of makeup air supplied to the external space. An exhaust for removing air from the room may be similarly responsive to a door open signal from the sensor to increase the quantity of air being exhausted from a negatively pressurized room and for decreasing the quantity of air being exhausted from a positively pressurized room.

For a number of embodiments of the invention, there are a plurality of rooms connected to a common external space or corridor, with an air flow offset which may be either positive or negative between each of the rooms and the external space. For preferred embodiments, the air flow offset for each of the rooms may be changed between positive and negative. A computing element is provided which determines the sum of the offsets for a given external space, with the air flow control utilizing this sum to control the air flow in the external space so as to achieve the desired air flow balance.

The air flow offset changing condition may be a change in air flow in a given room. Such change may occur for a variety of reasons including changes in actual exhaust and/or supply volume in the room or containment emergency in the room. The air flow control for the external space operates in response to a signal indicative of such air flow change in a pressurized room to cause a corresponding air flow change in the external space so as to maintain the desired air flow balance.

For one embodiment of the invention, a selector, such as a damper, is provided in a common makeup air supply for both the pressurized rooms and the external space, the selector determining the ratio of makeup air between the room and external space. The selector, which is part of the air flow control for the external space, operates in response to a signal indicative of an offset changing condition for the room to change the ratio of makeup air provided to the room and to the external space so as to achieve the desired change in air flow offset for the room while maintaining the desired air flow balance.

For another embodiment, an anteroom or airlock is provided between the pressurized room and the rest of the building in which the room is located (i.e. the corridor for the room). The anteroom may serve as the external space, having for example, an independently controlled air supply and exhaust and being operative to compensate for any air flow offset changes for the room so as to maintain a substantially constant air flow offset between the anteroom and the corridor.

The foregoing and other objects, features and advantages of the invention will be apparent from the following more particular description of preferred embodiments of the invention as illustrated in the accompanying drawings.

IN THE DRAWINGS

DETAILED DESCRIPTION

As stated earlier, pressurized rooms are utilized in a variety of facilities in industry, research, medicine and other areas. For purposes of illustration only, and not by way of limitation, the invention is being described in conjunction with FIGS. 1 and 2 in connection with illustrative medical and laboratory embodiments. However, these embodiments in particular, and the invention in general, may be practiced at any facility having pressurized rooms.

Figure 1:
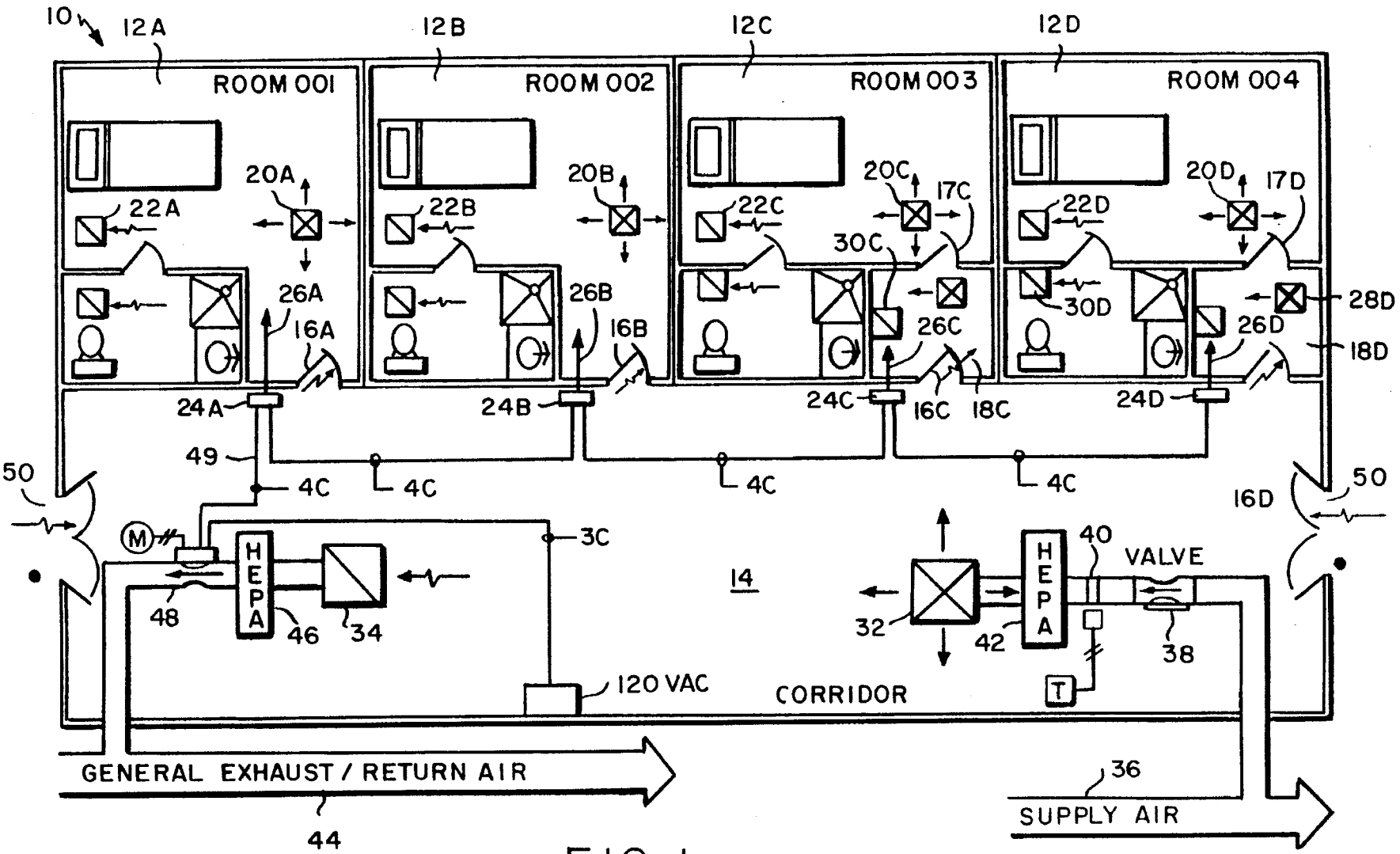
FIG. 1 is a schematic diagram illustrating the teachings of this invention being practiced in an illustrative hospital setting.

Referring to FIG. 1, an illustrative hospital ward 10 is shown which contains four pressurized hospital rooms 12A–12D, each of which may have its own bathroom. Rooms 12A and 12B connect directly to a corridor 14 through doors 16A and 16B, respectively. Rooms 12C and 12D are connected to the corridor through a sealed anteroom or airlock 18C and 18D, respectively. A door 16C, 16D is provided between airlock 18 and corridor 14 and a door 17C, 17D is provided between each airlock and to corresponding room 12. Each room 12 has an air flow supply 20A–20D, respectively, and an air flow exhaust 22A–22D, respectively. The supply 20 and exhaust 22 for each room are controlled in a standard fashion, except as otherwise discussed herein. The control for each supply and exhaust may, for example, come from a room monitor and control 24A–24D, the output lines 26A–26D from which are applied to control the supply and exhaust devices. It is noted that each of the airlocks 18 also has an air supply 28C, 28D and an exhaust 30C, 30D. These supplies and exhaust may also be controlled from controls 24 or may be controlled by other suitable elements. All of the supplies may be fed from a common supply line or duct 36 and all of the exhausts may feed into a common exhaust/return air line or duct 44.

Corridor 14 also has a supply 32 and an exhaust 34. Supply 32 receives makeup air from supply line 36 through an air flow control device 38 which may be a Venturi valve or other suitable valve, automatically controlled damper, a pressure independent variable air volume or constant volume terminal box, a direct digital controlled damper or box or other suitable device. For a preferred embodiment the device 38 is a Venturi valve and the term "valve" as used hereinafter shall be understood to include other flow control devices as well. The output from device or valve 38 passes through a thermostatically controlled reheat coil 40 and a hepa filter 42. The flow through valve 38 may be initially set in conventional fashion to provide a selected quantity of supply air. For the embodiment shown in FIG. 1, this quantity of air should be equal to the sum of the maximum, negative air volume offsets for the rooms 12A–12D.

Exhaust 34 is connected to a general exhaust/return air line 44 through a hepa filter 46 and a valve 48. For reasons which will be discussed later, an output from control 24A is connected to control exhaust value 48 Corridor 14 is connected to other areas of the hospital or the outside through doors 50.

In operation, airlocks 18C and 18D may be maintained at the same pressure level as the corresponding room 12, or may be maintained at a selected positive, negative, or neutral pressure level. Therefore, it will be assumed that the pressure level in each of the airlocks is the same as that in the corridor. Further, it will be assumed that each of the rooms is initially set to have a negative air flow offset of 100 cfm versus the corridor with airlocks 18 also having a 100 cfm offset to the corridor. It is further assumed that this is the maximum negative offset for each of the rooms so that valve 38 is set to cause supply 32 to provide 400 cfm through corridor 14. Since all of the air supplied by supply 32 through corridor 14 is required to support the offsets to the rooms 12A–12B and airlocks 18C–18D, none of this air needs to be exhausted by exhaust 34. Exhaust 34 may therefore be substantially blocked by valve 48. This obviously assumes ideal conditions. Adjustments may need to be made to take into account losses or other variations from ideal.

For the embodiment shown in FIG. 1, exhaust value 48 would be closed in response to an output from control 24 on line 49. The signal on line 49 may, for example, be an analog voltage or a digital value which is proportional to the sum of the air flow offsets for the rooms 12A–12B and airlocks 18C–18D, and is of a value to cause valve 48 to exhaust the appropriate amount of air to maintain a balance between the air flow in corridor 14 and the offsets between the corridor and the various rooms. For an illustrative embodiment, this sum is serially accumulated in the control units 24 with the offset monitored by unit 24D being added in unit 24C to the offset being monitored by that unit, and the sum of the offsets from unit 24C being applied to unit 24B where the offset for that room is also added. The sum from unit 24B is then applied to unit 24A where the final sum is accumulated and utilized to produce the signal on line 49.

Thus, for example, if a new patient is put in room 12B who is immundeficient so that isolation, rather than containment is required, a switch or other suitable control on unit 24B is operated to change room 12B from being negatively pressurized to being positively pressurized. This may, for example, result in a positive offset of 100 cfm across door 16B. The sum of the offsets therefore is changed from minus 400 cfm to minus 200 cfm. Since supply 32 is still providing 400 cfm through corridor 14, a control signal is applied to exhaust valve 48 to open this valve by an amount sufficient to cause 200 cfm to be exhausted through exhaust 34. The air flow balance in the ward or sub-facility 10 is thus maintained.

Similarly, if room 12B becomes empty so that pressurization is no longer required, the offset for this room would go to zero. This would result in the total offset dropping from 400 cfm to 300 cfm and an appropriate signal would appear on line 49 to valve 48 to make an appropriate change in the air exhausted from the corridor.

Figure 2:
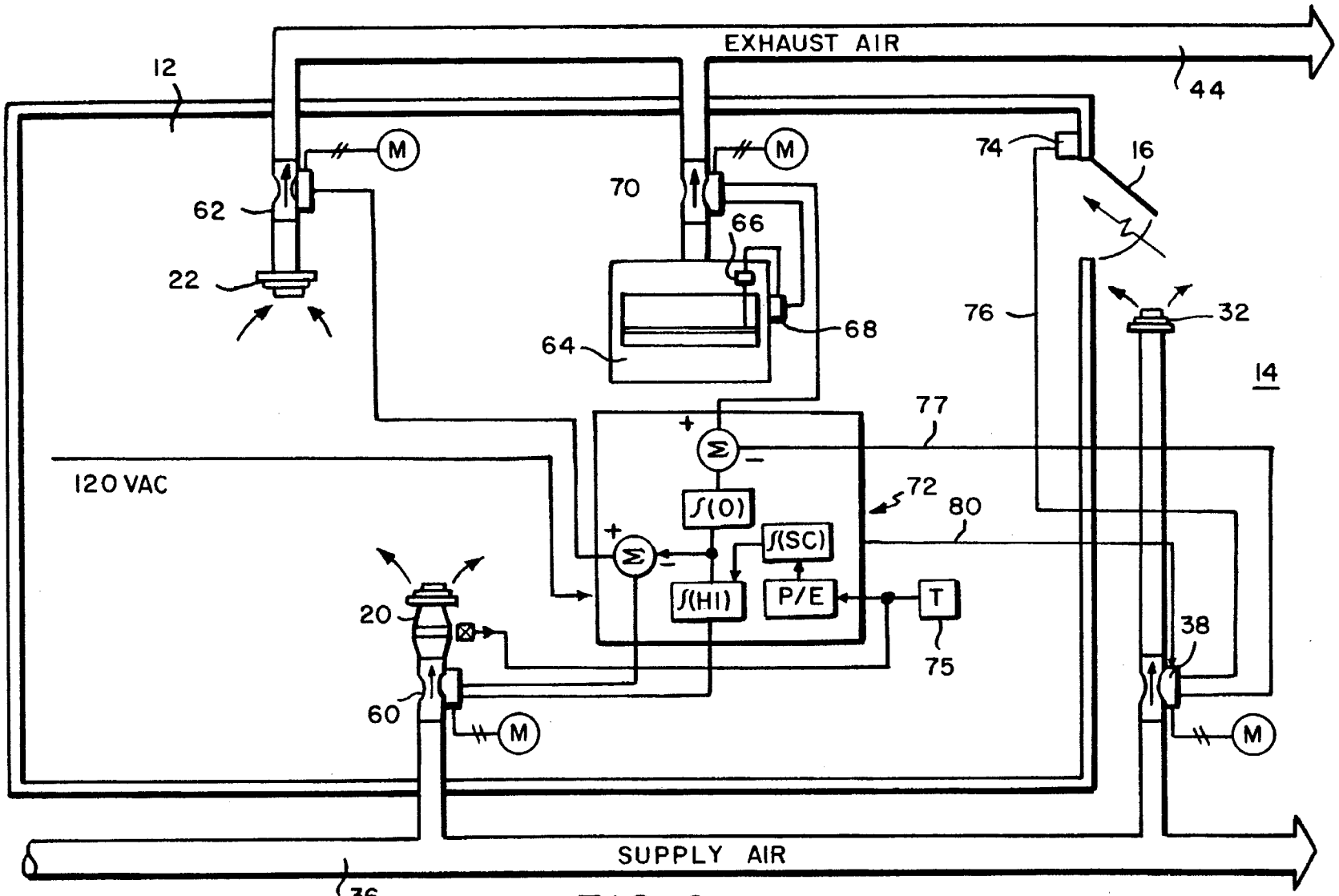
FIG. 2 is a schematic diagram of an alternative embodiment of the invention as applied in a laboratory setting.

FIG. 2 illustrates an alternative embodiment of the invention which is designed to compensate for the increased air flow which may be required when a door 16 to a pressurized room 12 is opened. In this case, for purposes of illustration, the room is illustrated as a laboratory room having an air flow supply 20 which is controlled by a supply valve, for example a valve 60, and an air flow exhaust 22 which is controlled by a valve, for example a valve 62. Room 12 is also shown as having a fume hood 64 with a vertical sash sensor 66 and a fume hood monitor 68. The fume hood is exhausted to general exhaust line/duct 44 through a valve 70. All of the valves 60, 62 and 70 are controlled from an electronic control 72 which may be of conventional design receiving inputs, for example, from the various valves, a room temperature sensor 75, and other suitable sources. For purposes of illustration, corridor 14 is shown as only having a supply 42 with the volume from supply 32 being controlled by makeup air valve 38.

Finally, a door position sensor 74 is provided which generates an output on line 76. The signal on line 76, which may be digitized, but is currently analog, is applied to the controller for valve 38 to control the air volume supply to corridor 14. Line 77 from the controller for valve 38 is connected to control 72 and through control 72 to valve 62 to control the air exhausted from room 12 and/or valve 60 to control the amount of makeup are supplied to room 12. Line 76 could also be applied directly to control 72 to control air flow in room 12.

Sensor 74 may be a binary sensor generating a first signal on line 76 when door 16 is closed and second signal on line 76 when the door is open by more than a pre-determined amount, for example, two to six inches. Alternatively, sensor 74 may be a multi-position sensor generating a number of different outputs when door 12 is open within various positional ranges. It is also possible for sensor 74 to generate a continually varying output as door 16 is open. Such a sensor could be of the same type as shown in U.S. Pat. No. 4,706,553 assigned to the same assignee as this application.

The embodiment of FIG. 2 is designed to deal, for example, with the problem previously discussed where it is desired to maintain a low air flow offset through door 16 when the door is closed, but because of the temperature gradient across the door and for other reasons, it is desirable to increase the air flow across the door to, for example 50 to 100 fpm when the door is open. In the simplest embodiment, both valve 38 and valve 62 would be set to provide an air flow across door 16 of 10 fpm when the door is closed. With a binary sensor 74, when the door opened beyond the threshold, the change signal on line 76 would be applied both to increase the air flow through valve 38 and supply 32 and to increase the exhaust through exhaust 22 and valve 62 so as to provide the higher offset value. Supply 20 may be controlled either instead of or in addition to exhaust 22. With a stepped multi-position sensor 74, each incremental change on line 76 would result in an either greater or lessor air flow through supply 32 and exhaust 22 so as to achieve a desired air flow offset for the particular door position. This may be advantageous to achieve containment without requiring the expenditure of larger amounts of energy than absolutely required. Finally, with a continually varying output on line 76, there would be a corresponding continual variance in the flows through valves 38 and 62. However, the variance in flow through the valves may not be a linear function of door position, having for example, a parabolic curve which rises more quickly as the door begins to open and then levels off as the door approaches its fully opened position.

FIG. 2 may also be utilized to illustrate another feature of the invention wherein the supply from valve 38 may be effected by conditions in room 12. As discussed earlier, such changes may be changes in air flow in the room which make a change in air flow offset desirable or may result from a containment emergency which is not compensated by room supply 20. Thus, in the figure, a line 80 from control 72 is shown as an additional input to the controller for valve 38 causing valve 38 to control the makeup air provided by corridor supply 42. This change could be an increase or decrease in flow depending on the desired air flow offset change.

Figure 3:
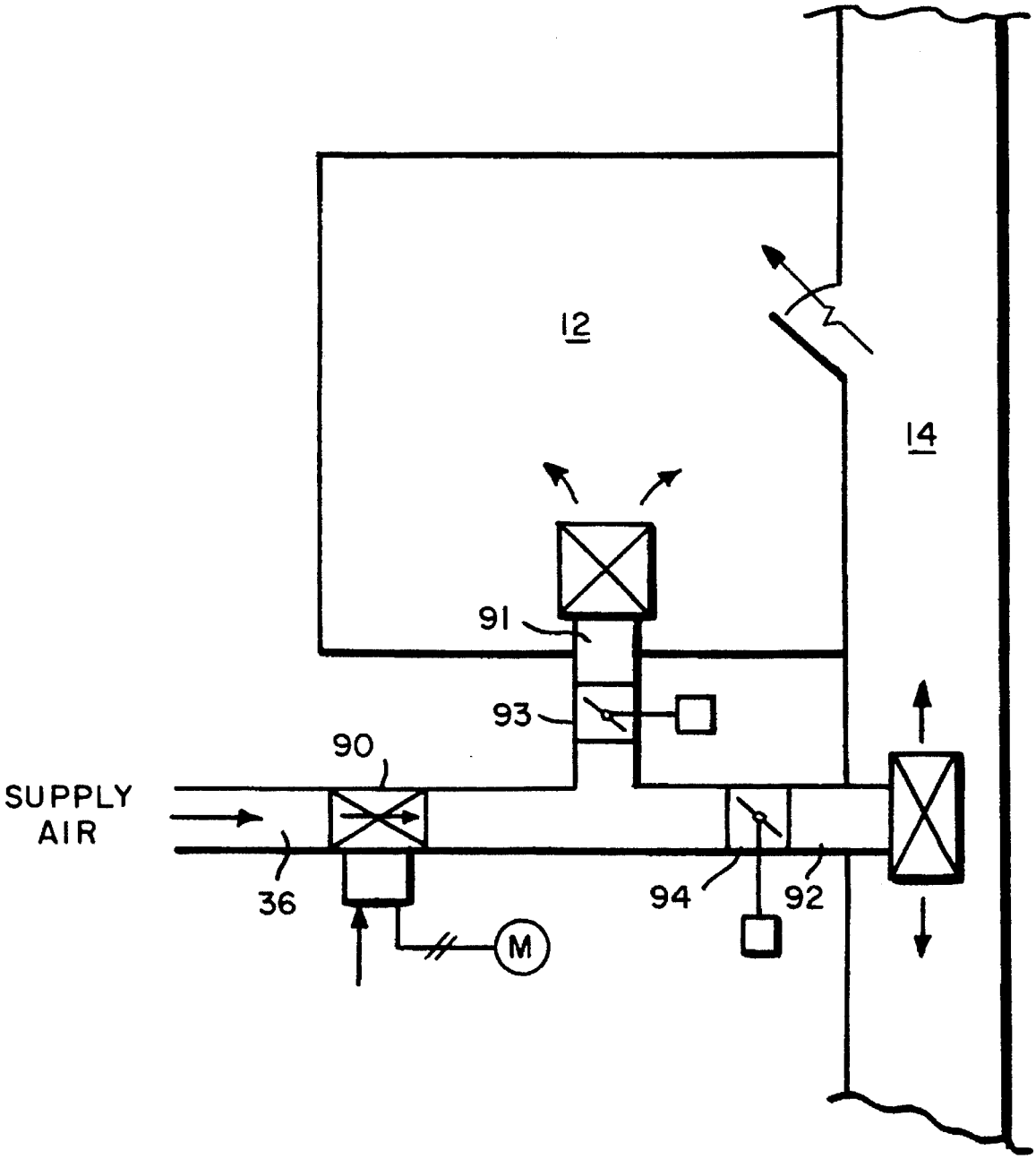
FIG. 3 is a drawing of a flow control portion for a further embodiment of the invention.
Figure 4:
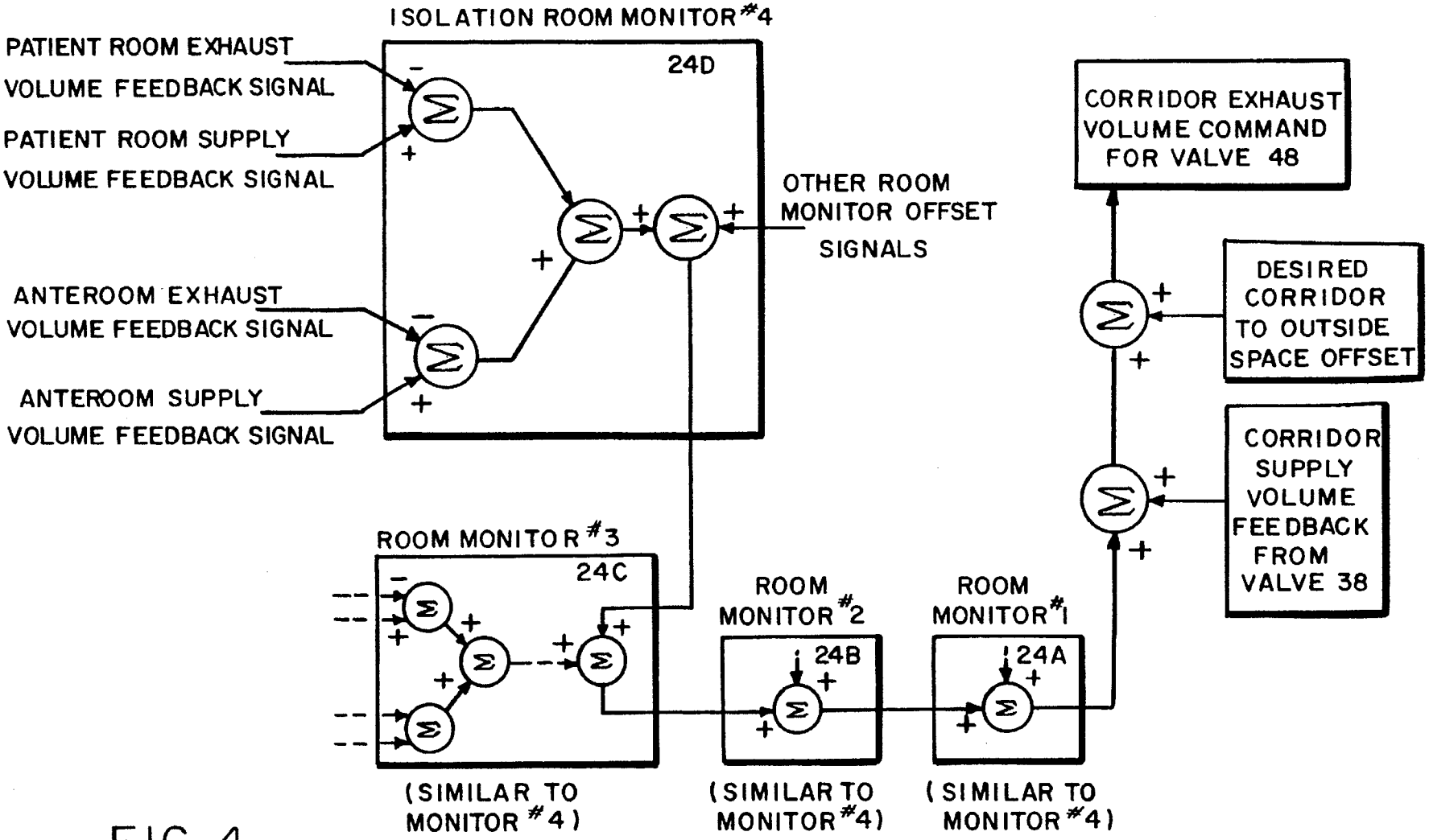
FIG. 4 is a schematic semi-block diagram of a control suitable for use as control 24 in FIG. 1.

While in FIG. 1, the control of air flow in corridor 14 is shown as being effected through exhaust valve 48 and in FIG. 2 this control is shown as being effected through supply valve 38, it is apparent that the control may be effected for a given embodiment by either the supply or exhaust valve or by operating both valves. Further, referring to FIG. 2, it is seen that the makeup air for room 12 and for corridor 14 are both obtained from a common supply line 36. Therefore, as illustrated in FIG. 3, both room makeup valve 60 and corridor makeup valve 36 may be replaced by makeup valve 90 supplying a controlled amount of makeup air from supply 36 to supply branch lines 91 and 92. Supply branch line 91 feeds room 12 and branch line 92 feeds the corridor 14. Controlled dampers or airflow control devices 93 and 94 are used to proportion or control whether the makeup air provided by valve 90 goes to either the room or the corridor or a combination of both. Typically as one of 93 or 94 is opened, the other damper would be closed to change the ratio of markup air flow between the room and the corridor to achieve a desired offset air flow. Thus, while the invention has been particularly shown and described above with reference to preferred embodiments, the foregoing and other changes in form and detail may be made therein by those skilled in the art without departing from the spirit and substance of the invention.

What is claimed is:

1. A control for maintaining a desired air flow balance between at least one pressurized room and an external space connected to such room, there normally being a selected air flow offset between each room and the external space, the control comprising:

an element which generates a signal indicative of a selected offset changing condition for at least one of said air flow offsets; and an air flow control for said external space which control is responsive to said signal for changing the air flow in at least said external space to achieve the selected changed offset while maintaining said desired air flow balance.

2. A control as claimed in claim 1 wherein said air flow control controls the quantity of makeup air supplied to said external space.

3. A control as claimed in claim 2 wherein said air flow control also control the exhaust of air from said external space.

4. A control as claimed in claim 1 wherein said air flow control controls the exhaust of air from said external space.

5. A control as claimed in claim 1 including an air flow control for controlling the air flow in each of said pressurized room, each of said room air flow controls being responsive to a signal indicative of a selected offset changing condition for the room for changing the air flow in the room to achieve the selected changed offset.

6. A control as claimed in claim 5 wherein a room air flow control includes an exhaust for removing air from the room, the air flow in the room being controlled by controlling the air outputted by said exhaust.

7. A control as claimed in claim 1 wherein there is a door between each pressurized room and the external space, the air flow offset being primarily across said door, wherein the selected offset changing condition is the opening and closing of said door, and including a sensor which detects the open state of each door, said signal being generated by said sensor.

8. A control as claimed in claim 7 wherein said room is negatively pressurized relative to said external space, and wherein said air flow control is responsive to a signal from said sensor indicating that the door is open for increasing the quantity of makeup air supplied to the external space.

9. A control as claimed in claim 8 including an exhaust for removing air from said room; and wherein said exhaust is responsive to said signal indicating that the door is open for increasing the quantity of air being exhausted from the room.

10. A control as claimed in claim 9 wherein said sensor is a two position sensor generating a first signal when the door is closed and a second signal when the door is open by at least a selected amount, the air flow control and the exhaust being responsive to the second signal to respectively increase the quantity of makeup air supplied to the external space and the air exhausted from the room.

11. A control as claimed in claim 7 wherein said room is positively pressurized relative to said external area and wherein said air flow control is responsive to a signal from said sensor indicating that the door to the room is open for decreasing the quantity of makeup air supplied to the external area.

12. A control as claimed in claim 7 wherein said sensor generates a plurality of output signals, each of which is indicative of the position of the door being within a given range; and wherein said air flow control is responsive to each of said offset signals for providing a different air flow in said external space.

13. A control as claimed in claim 7 wherein said sensor generates an output signal which varies as a substantially linear function of door position; and wherein said air flow control is responsive to said output signal to provide a corresponding substantially continuous change in the air flow for said external space.

14. A control as claimed in claim 1 wherein there are a plurality of pressurized rooms connected to an external space, there being a selected air flow offset between each of said rooms and said external space which offsets may each be independently controlled; and wherein said element generates a separate signal indicative of a selected offset changing condition for each of said offsets, and including a mechanism for calculating the sum of the air flow offsets between each of the rooms, and the external space, said air flow control being responsive to said calculated sum for providing a net air flow to said external space which is substantially equal to said determined sum of air flow offsets.

15. A control as claimed in claim 14 wherein air flow offset between each of said pressurized rooms and the external space may be either positive or negative, and including a switch for changing the offset for at least one of said rooms between positive and negative.

16. A control as claimed in claim 1 wherein the selected offset changing condition is a substantial change in the air flow for a pressurized room and wherein said air flow control is responsive to a signal indicative of said change in air flow in a room for making a corresponding change in the air flow for said external space, thereby maintaining said desired air flow balance.

17. A control as claimed in claim 1 wherein makeup air is provided to both the external space and the pressurized rooms from a common makeup air source, and including a selector for controlling the relative amounts of makeup air directed to each pressurized room and the external space, the selector being responsive to a signal indicative of the selected offset changing condition for a given room for controlling the selector to change the ratio of makeup air between the room and the external space so as to effect the selected air flow offset change while maintaining the desired air flow balance.

18. A control as claimed in claim 1 wherein said pressurized room is part of a building, wherein said external space is an anteroom between the pressurized room and the remainder of said building, said air flow control being operative to compensate for any air flow offset changes indicated by said signal so as to maintain a substantially constant offset between the anteroom and the remainder of the building.

* * * * *